United States Patent [19]

Tsuji

[11] Patent Number: 4,936,027

[45] Date of Patent: Jun. 26, 1990

[54] HAIR DRYER AND STEAMER COMBINATION

[75] Inventor: Eiji Tsuji, Hikone, Japan

[73] Assignee: Matsushita Electric Works, Ltd., Osaka, Japan

[21] Appl. No.: 213,796

[22] Filed: Jun. 30, 1988

[51] Int. Cl.[5] ..... F26B 19/00

[52] U.S. Cl. ..... 34/90; 34/97; 34/101; 219/373; 219/370; 132/228

[58] Field of Search ..... 34/96, 90, 97, 98, 99, 34/101; 132/227, 228, 229, 233; 219/362, 370, 373

[56] References Cited

U.S. PATENT DOCUMENTS

| | | | |
|---|---|---|---|
| 3,814,898 | 6/1974 | Levine | 34/97 X |
| 3,947,659 | 3/1976 | Ono | 219/370 X |
| 4,419,565 | 12/1983 | McGaw | 132/229 X |

FOREIGN PATENT DOCUMENTS

| | | | |
|---|---|---|---|
| 3234014 | 3/1984 | Fed. Rep. of Germany | 34/96 |

*Primary Examiner*—Henry A. Bennet
*Assistant Examiner*—John Sollecito
*Attorney, Agent, or Firm*—Armstrong, Nikaido, Marmelstein, Kubovcik & Murray

[57] ABSTRACT

A hair dryer and steamer combination includes a handle housing mounting a fan blower producing a flow of air and a hair brush attachment having a hair engaging surface for seizing the hair to be styled. Included in the hair brush attachment is a heater which heats the water supplied from a water supplying tank at the end of the attachment to generate the steam. The attachment has its interior divided into an air flow chamber open rearwardly into the handle housing and a steam chamber accommodating the steam heater. The air flow chamber is provided with a number of air vents through which the air flow from the handle housing is discharged outwardly for drying the hair in engagement with the hair engaging surface. The steam chamber has a number of steam vents for discharging the steam outwardly for moistening the hair in engagement with the hair engaging surface. These air flow and steam chambers are separated from each other so that the steam generated within the steam chamber will not be directed to the air flow chamber and is only allowed to be discharged through the steam vents. The steam chamber and the hair engaging surface are defined commonly by a single member having good thermal conductivity so that the heat generated at the heater is transferred by conduction to the hair engaging surface for keeping it at a raised temperature, whereby effectively preventing the steam from being condensed on that surface.

12 Claims, 8 Drawing Sheets

HAIR DRYER AND STEAMER COMBINATION

BACKGROUND OF THE INVENTION

1. Field of the Invention

The present invention is directed to a hair dryer and steamer combination capable of styling hair by selectively moistening and drying the hair.

2. Description of the Prior Art

Such hair dryer and steamer combination is known as disclosed in British Pat. No. 1,530,360 in which a handle incorporating a blower fan is connected to a curler rod within which a heater is disposed. The heater is supplied with water from a water reservoir for generating steam which is directed through a number of vents in the curler rod for moistening the hair wound about the curler rod. In this prior device, the vents are commonly used to discharge the flow of air from the fan blower as well as to discharge the steam. With this structural arrangement of the prior art device, the steam generated at the heater will be firstly directed to the space formed between the heater and the inner wall of the curler rod prior to being discharged outwardly of the curler rod for moistening the hair. Since this space is also utilized commonly to direct the flow of air for a hair drying purpose and is inherently an enlarged space, the steam has a greater chance of being cooled while passing such enlarged space and is more likely to form droplets of water on the inner and outer surface of the curler rod. With this result, a large volume of the steam may fail to reach the hair to be moistened, lowering the moistening effect and resulting in energy loss. This undesirable formation of water droplets is further promoted when the hair engaging surface of the curler rod remains at a lower temperature relative to the steam, since the steam once discharged outwardly of the curler rod is readily cooled to be condensed in contact with the hair engaging surface at the lower temperature.

SUMMARY OF THE INVENTION

The above problem has been eliminated in the present invention which is contemplated to provide a hair dryer and steamer combination of improved performance. The combination set of the present invention comprises a handle housing mounting therein a fan blower for producing a flow of air and formed at its front end with a discharge port for discharging the flow of air. Connected to the front end of the handle housing is an elongated hair brush member which has a hair engaging surface extending in the lengthwise direction of the hair brush member for engaging hair strands to be styled and which has a steam generating device comprising a water supplying means and an electric heater for heating the water supplied from the water supplying means to generate the steam. The hair brush member is in the form of a hollow tube provided with an air flow chamber and a steam chamber which extend lengthwise of the hair brush member and are separated from each other. The air flow chamber is open at its rear end to the discharge port and is provided with a number of air vents for discharging therethrough the flow of air for drying the hair in engagement with the hair engaging surface. The steam chamber is closed to the discharge port and accommodates therein the electric heater. The steam chamber has a portion forming the part of the hair engaging surface and is provided in that portion with a number of steam vents for discharging the steam generated at the heater to the hair in engagement with the hair engaging surface. With this separate formation of the steam chamber from the air flow chamber within the hair brush member, the steam generated in the steam chamber can be directed only through the steam vent and not directed to the air flow chamber prior to being discharged outwardly of the hair brush member, thus prevented from contacting with widened surfaces and correspondingly having less chance of being cooled to condensation. Thus, the steam is effectively discharged outwardly for moistening the hair while reducing the formation of water droplets which would fail to moisten the hair. Further, the steam chamber and the hair engaging surface are defined commonly by a single member having good thermal conductivity so that the hair engaging surface can be also heated by the steam generating heater so as not to act to cool or condense the steam spreading over the hair engaging surface. This contributes, in addition to the separate formation of the steam chamber, to prevent effectively the formation of droplets or to keep the steam longer effective for moistening the hair.

Accordingly, it is a primary object of the present invention to provide a hair dryer and steamer combination which is capable of being selectively utilized as a dryer and a steamer by a single device, yet preventing the formation of water droplets and producing a long-lasting steam effective for moistening the hair.

The portion of the steam chamber forming the part of the hair engaging surface extends lengthwise of the hair brush member in the middle of the lateral direction thereof so that the steam vents are disposed in the laterally middle of the hair engaging surface while the air vents are disposed in the lateral ends thereof. In other words, the steam chamber acting as the heat source for the hair engaging surface is located centrally of the hair engaging surface in its lateral direction for reducing a temperature difference between the lateral ends of the hair engaging surface, thus obtaining gentle temperature distribution curve in the lateral direction of the hair engaging surface for effective prevention of the condensation of the steam, which is therefore another object of the present invention.

In a preferred embodiment, the hair engaging surface is formed with at least one axially extending groove along which said steam vents are spaced so that the steam discharged from one of the steam vents can be directed along the groove and is therefore allowed to spread over the entire length of the groove or the hair engaging surface.

It is therefore a further object of the present invention to provide a hair dryer and steamer combination in which the steam can easily be spread over the length of the hair brush member.

In this connection, the groove is filled with a steam diffusion pad of moisture absorbing capability, which serves to uniformly spread the steam over the length of the hair engaging surface and also serves to recover the water droplets for preventing them from dripping on the hair brush member. This improves operability of the hair dryer and steamer combination.

The water supplying means comprises a tank and a plug with a moisturizing pad extending from within the tank for transferring the water to the electric heater. The steam chamber is defined by a pipe which is open to the front end of the hair brush member for detachably receiving the plug. The pipe is sealed at its front end to the plug and at its rear end to electric heater so as to define between the front and rear sealed portions a space within the length of which the electric heater is in contact with the water carrying moisturizing pad for generating the steam.

It is therefore a further object of the present invention to provide a hair dryer and steamer combination in which the pipe accommodating the steam generating heater is sealed at its both ends for preventing the steam from escaping in an undesired direction.

Provided within the sealed space in the pipe is a water absorbent material for absorbing the water droplets remaining in the pipe. That is, excess droplets formed in the pipe due to the condensation of the steam can be collected and are therefore prevented from flowing outwardly of the hair brush member, which is therefore a further object of the present invention.

The plug is bifurcated to have a pair of retainer legs which extend lengthwise of the pipe for carrying the moisturizing pad along the length thereof. When the plug is inserted in the pipe, the retainer legs are held in an overlying relation to the steam generating heater along the length of the pipe in order to press the moisturizing pad against the electric heater along its length. Thus, the moisturizing pad can be in pressed contact over an extended length against the heater to increase steam generating efficiency. This is particularly advantageous when a positive temperature coefficient (PTC) heater is employed, since the PTC heater becomes more sensitive against the temperature as its contact area with the moisturizing pad increases to thereby effect consistent current regulation.

It is theretofore a further object of the present invention in which the steam generating heater is well coordinated with the water supplying means for increasing steam generating efficiency.

These and still other objects and advantages of the present invention will become more apparent from the following description of the preferred embodiment of the present invention when taken in conjunction with the attached drawings.

DESCRIPTION OF THE PREFERRED EMBODIMENT

Figure 1:
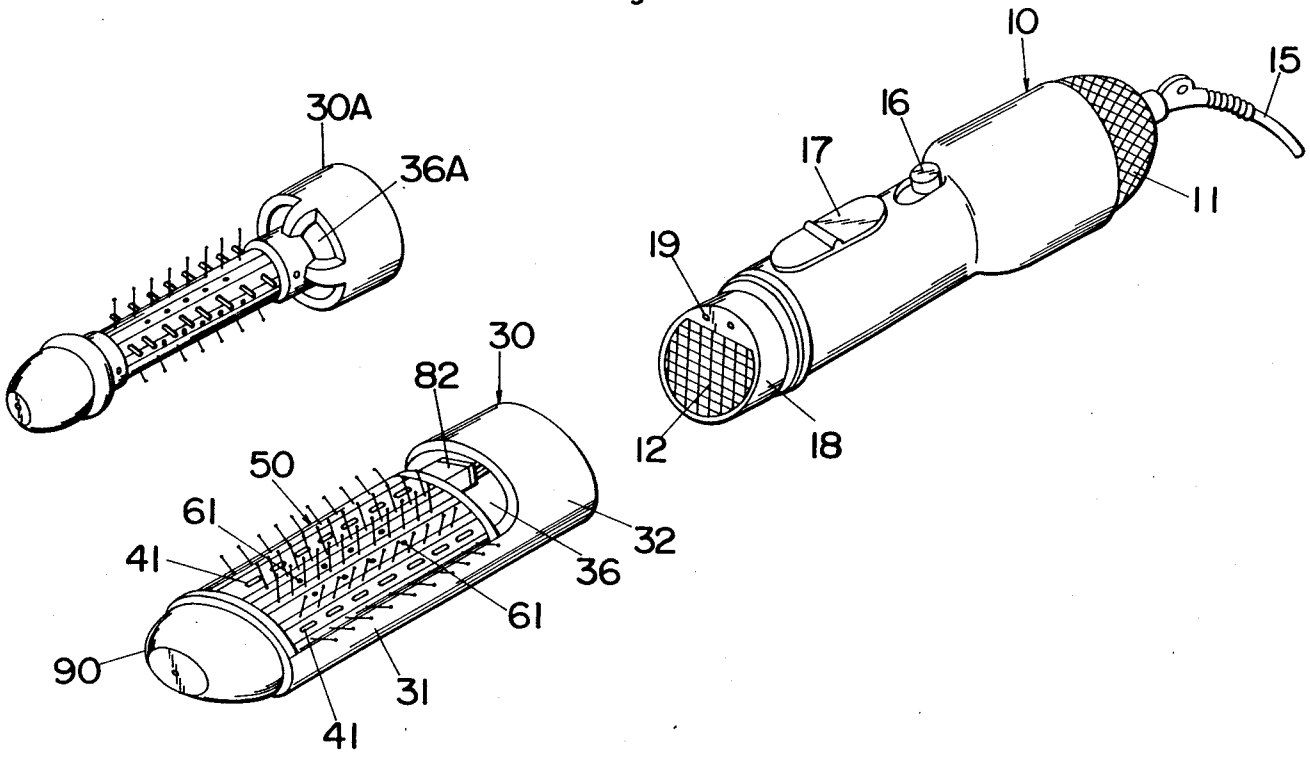
FIG. 1 is a perspective view of a hair dryer and steamer combination in accordance with a preferred embodiment of the present invention.

Referring now to FIG. 1, there is shown a hair dryer and steamer combination in accordance with the present invention. The combination hair styling device comprises a handle housing 10 and a hair brush attachment 30 detachably connected to the handle housing 10. Another type of attachment 30A in the form of a curler rod may be selectively attached to the handle housing 10, as necessary. The curler rod 30A is of conventional structure with a steam generating heater (not shown) and an air directing aperture 36A and therefore no detailed explanation thereof is deemed necessary.

Figure 2:
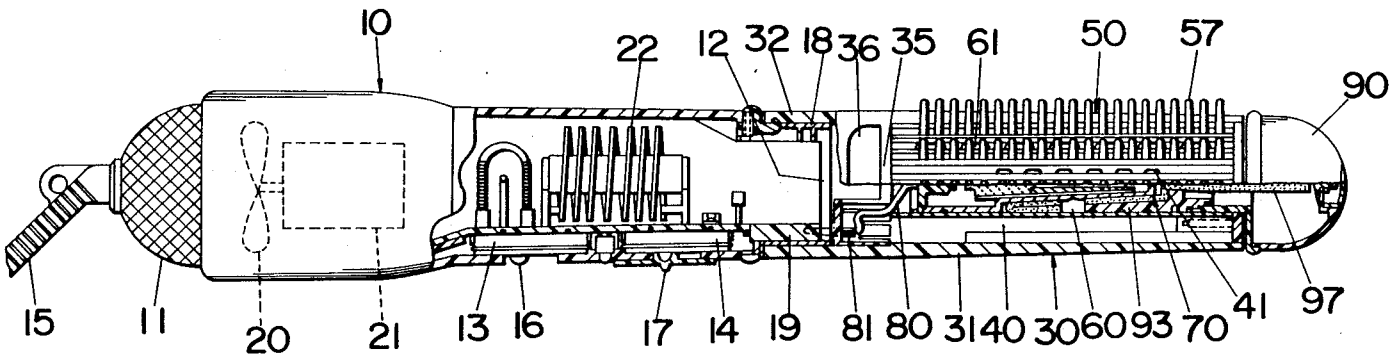
FIG. 2 is a sectional view, partly in elevation, of the above combination.
Figure 3:
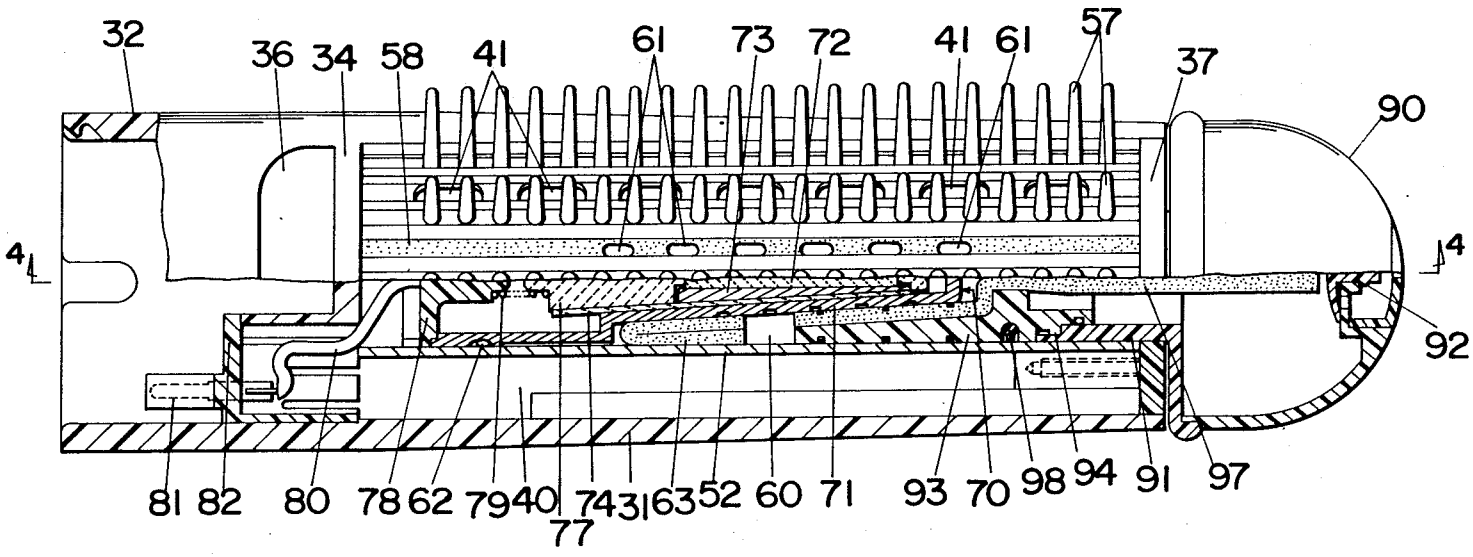
FIG. 3 is a top view, partly in section, of a hair brush attachment utilized in the above combination.

As shown in FIG. 2, the handle housing 10 is cylindrical in shape and accommodates in its rear portion an electric motor 21 and a fan blower 20 driven thereby to draw air from the rear inlet 11 and discharge it through a port 12 at the front end of the handle housing 10. Disposed forwardly of the motor 21 is a resistive heater 22 for heating the flow of air produced by the fan blower 20. The motor 21 and the heater 22 are connected to an electric source of power by means of electric switches 13 and 14 and a power cord 15 extending from the rear end of the handle housing 10. The switches 13 and 14, which are disposed in tandem relation at a radially outwardly offset position within the handle housing 10, are respectively manipulated by slide handles 16 and 17 to energize the motor 21 and the heater 22, respectively. The handle housing 10 can be alone utilized as a hair dryer.

The hair brush attachment 30 is provided with a steam generating heater 70 for moistening hair with the steam in order to facilitate hair styling. The hair brush attachment 30 is shaped into a flattened tube which is formed at its rear end with a sleeve 32 for detachably receiving therein a nose 18 formed at front end of the handle housing 10 to surround the discharge port 12 thereof. Provided at the flatted top of the hair brush attachment 30 is a hair engaging surface 50 for engagement with the hair to be styled. A water tank 90 is detachably connected to the front end of the hair brush attachment 30 for supplying a volume of water to the heater 70 for generation of the steam.

Figure 5:
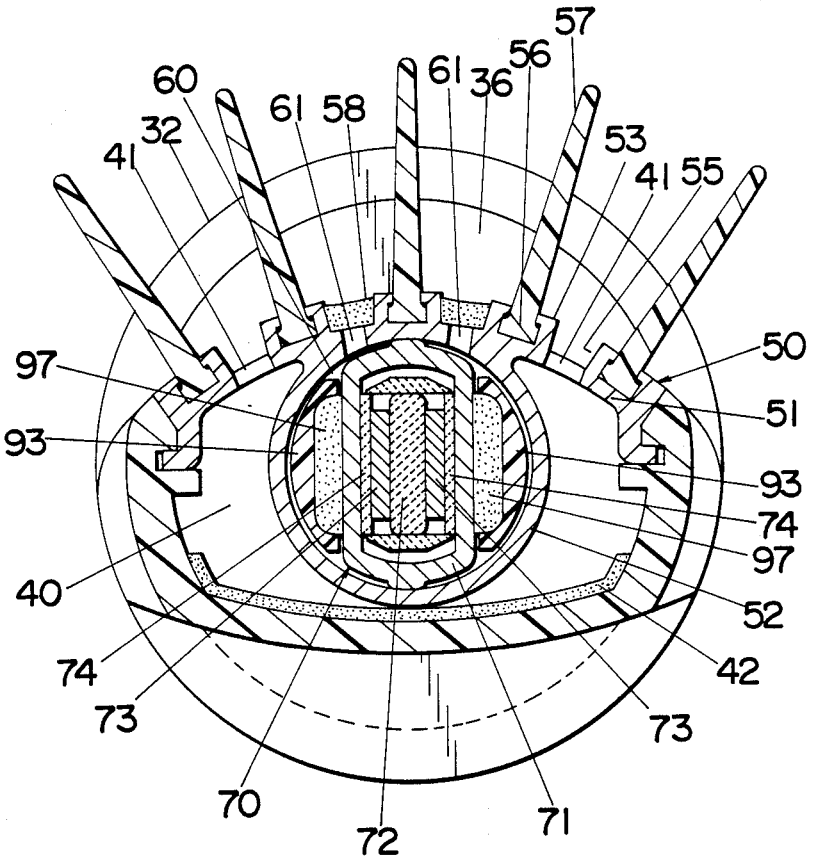
FIG. 5 is a cross section taken along line 5—5 of FIG. 4.
Figure 6:
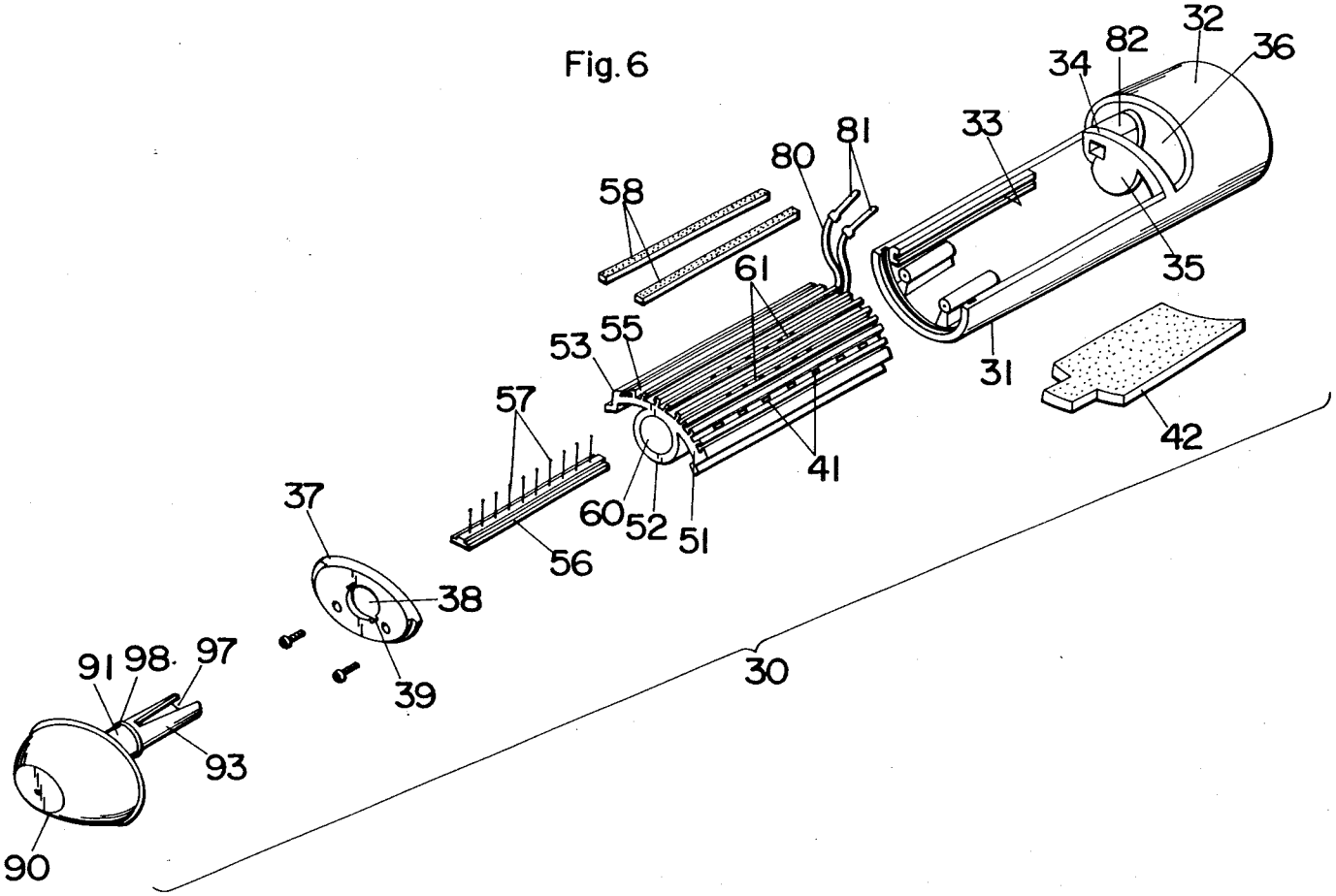
FIG. 6 is an exploded perspective view of the hair brush attachment.

As shown in FIG. 6, the hair brush attachment 30 comprises a base 31 formed from a plastic material to be integral with the sleeve 32, an aluminum-made fitting consisting of an arcuate plate 51 defining thereon the hair engaging surface 50 and a pipe 52 for receiving therein the steam generating heater 70. The pipe 52 is of circular section and extends integrally on the underside of the arcuate plate 51 at the lateral center thereof with its portion merged into the center of the arcuate plate 51. The fitting covers a top opening of the base 31 with the side edges of the arcuate plate 51 inserted in corresponding slits 33 in the base 31 so that it extends the substantial length of the hair brush attachment 30. The rear end of the arcuate plate 51 is held against a stop rib 34 of the base 31, while the rear end of the pipe 52 is closed by with a tab 35 at the middle of the stop rib 34. The stop rib 34 is formed forwardly of the sleeve 32 to form therebetween an enlarged aperture 36 which allows the air flow from the handle housing 10 to be partly discharged therethrough for drying the hair in engagement with the hair engaging surface 50. Secured to the front end of the base 31 is an end plate 37 with an opening 38 which is only in communication with the interior of the pipe 52. The arcuate plate 51 is formed in its outer surface with rows of ridges 53 and grooves 55 which extend in the lengthwise direction and alternate with each other in the lateral direction, as shown in FIG. 5. Each of the ridges 53 is also formed with a channel for retaining therein a fillet 56 with a number of hair engaging bristles 57.

Figure 4:
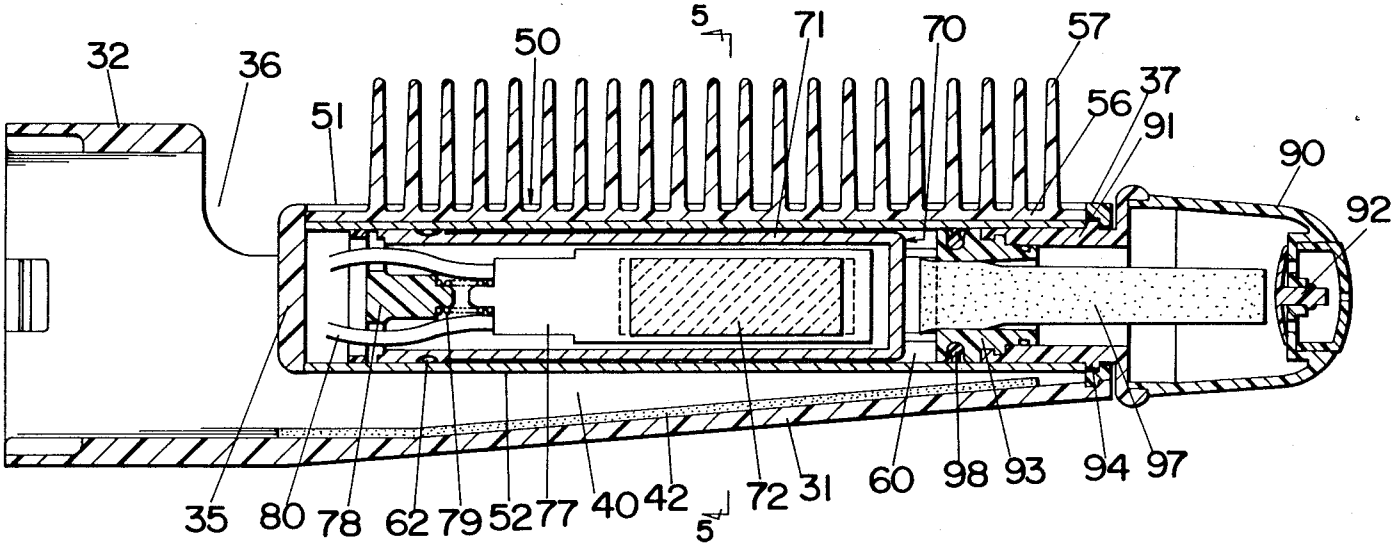
FIG. 4 is a cross section taken along line 4—4 of FIG. 3.

As shown in FIG. 5, the arcuate plate 51 is cooperative with the base 31 to define therebetween an air flow chamber 40 which is in open communication at its rear end with the sleeve 32, as shown in FIG. 4, and is closed at its front end by the end plate 37. The arcuate plate 51 is provided a number of air vents 41 which open to the bottom of the grooves 55 located at the laterally opposite ends of the arcuate plate 51 so that the air flow generated by the fan blower 20 is directed to the air chamber 40 and discharged outwardly through the air vents 41 for hair drying. The pipe 52 defines therein a steam chamber 60 which is separated from the air flow chamber 40 and has a number of steam vents 61 which are open to the hair engaging surface 50 at the lateral center of the arcuate plate 51 so that the steam is discharged outwardly only through the steam vents 61 and is not routed into the air flow chamber 40. The air vents 41 and the steam vents 61 are provided within the corresponding grooves 55 and arranged in a spaced relation along the length of the hair brush attachment 30. Each of the grooves 55 provided with the steam vents 61 are filled with a diffusion pad 58 made of a heat-resistive felt fabric for diffusing the steam substantially uniformly along the length of the corresponding grooves 55 to obtain an uniform hair moistening effect over an extended area of the hair. The diffusion pad 58 is also capable of absorbing the moisture so that it can collect an excess amount of water resulting from the condensation of the steam. In this connection, a like moisture absorbing mat 42 is disposed over the inner bottom of the base 31 or the air flow chamber 40 in order to collect the water accidentally entering the chamber 40 through the air vents 41.

Figure 7:
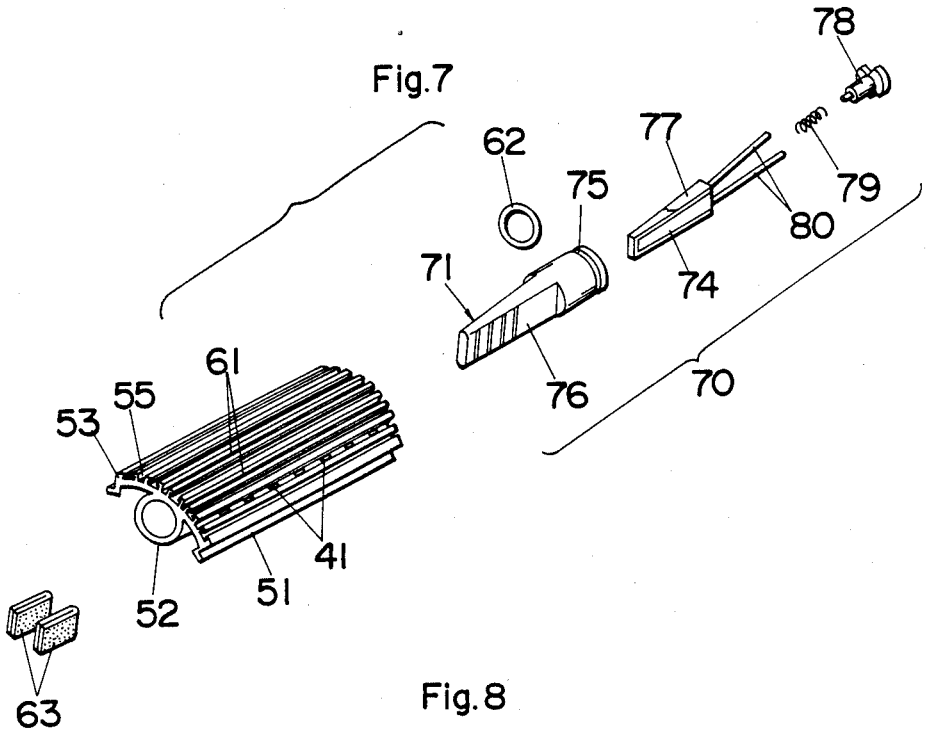
FIG. 7 is an exploded perspective view of particular components forming the hair brush attachment.
Figure 8:
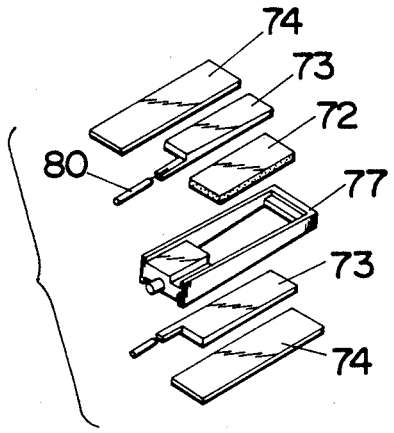
FIG. 8 is an exploded perspective view of a steam generating heater accommodated in the hair brush attachment.

Referring to FIGS. 7 and 8, the steam generating heater 70 comprises a wedge-shaped sheath 71 within which a PTC resistor 72 is received together with associated electrodes 73 and insulators 74. The sheath 71 is made of aluminum having good thermal conductivity and is secured within the pipe 52 by a nipple 75 of circular section integrally formed at the rear end of the sheath 71. The PTC resistor 72 is held in a wedge-shaped holder 77 between the electrodes 73 and is inserted in a wedge portion 76 of the sheath 71 with each of the insulators 74 positioned between each electrode 73 and the adjacent inner surface of the sheath 71. The insulators 74 are made of ceramic material having good thermal conductivity for efficient heat transfer to the sheath 71. A fixture 78 is inserted in the rear end or the nipple 75 of the sheath 71 to urge the holder 77 forwardly through a spring 79 such that the insulators 74 are forced into pressed contact with the inner surface of the wedge portion 76. A pair of conductor leads 80 connected to each of the electrodes 73 extend rearwardly of the sheath 71 and terminate in terminal pins 81 held in a terminal block 82 for electrical connection with a corresponding socket connector 19 formed at the front end of the handle housing 10. The socket connector 19 is electrically connected to the switch 14 so that the heater 70 is selectively energized by the manipulation of the slide handle 17. It is noted at this point that, as shown in FIGS. 1 and 2, the socket connector 19 is disposed at a peripheral portion of the discharge port 12 in lengthwise alignment with the switches 13 and 14 in the handle housing 10. This means that the socket connector 19 can be mounted at the front end of the handle housing 10 in a best position effective for keeping the loss of air flow at a minimum, while enabling the electrical connection to the steam generating heater 70 in the hair brush attachment. In a like sense, the terminal pins 81 or the terminal block 82 is located at a peripheral portion within the sleeve 32 adjacent the stop rib 34 so as not to cause a substantial resistance against the air flowing from the handle housing 10 toward the air flow chamber 40.

The tank 90 for supplying water to the heater 70 has a rearwardly extending spout 91 for receiving a volume of water and a pressure regulating valve 92 at an end opposite to the nose 91. The tank 90 is connected to the front end of the hair brush attachment 30 with its spout 91 inserted to the steam chamber 60 or the pipe 52 through the opening 38 of the end plate 37 and is detachable thereto by means of projections 94 formed on the spout 91 in diametrically opposed relation to each other. The projections 94 are allowed to pass through corresponding notches 39 in the periphery of the opening 38 and come into engagement with the periphery of the opening 38 when the tank 90 is rotated about the axis of the spout 91. A plug 93, which is removably connected at its front end to the spout 91, extends rearwardly and supports a wick 97 made of heat resistive felt fabric. The substantial portion of the plug 93 is bifurcated to provide a pair of legs which straddle the opposed surfaces of the heater 70 over an extended length thereof upon insertion of the plug 93 into the pipe 52 of the hair brush attachment 30. The wick 97 has its one end projected into the tank 90 for contact with the water filled therein and has the other end respectively extended along the opposed inner surface of the bifurcated legs 93 so that, upon attachment of the tank 90, the portion of the wick 97 is pressed against the opposed wedge surfaces of the heater 70 by the bifurcated legs 93 for establishing a tightly pressed contact between the wick 97 and the heater 70. Thus, the heater 70 is constantly supplied over an extended surface area with the water from the tank 90 to efficiently generate the steam, which expands in a limited space within the steam chamber 60 and is immediately discharged outwardly through the steam vents 61 for moistening the hair in engagement with the hair engaging surface 50 of the hair brush member 30. During the steam generating mode, the heater 70 serves also to heat the hair engaging surface 50 through the medium of the pipe 52 and the arcuate plate 51 which are integrally formed from aluminum having good thermal conductivity, whereby the heat engaging surface 50 can be kept at a raised temperature for effectively preventing the condensation of the steam on that surface and therefore reducing considerably the amount of water droplets which would otherwise formed on that surface.

The steam chamber 60 is sealed at its longitudinal ends respectively by means of first and second O-rings 62 and 98 for prevention of any undesirable leakage of the steam. The first O-ring 62 is fitted over the rear end of the heater sheath 71, while the second O-ring 98 is fitted over the plug 93 forwardly of the bifurcated legs 93. A water absorbent pad 63 is also disposed within the steam chamber 60 between the sealed ends and rearwardly of the plug 93 for absorbing the water content which may be formed therein.

Figure 9:
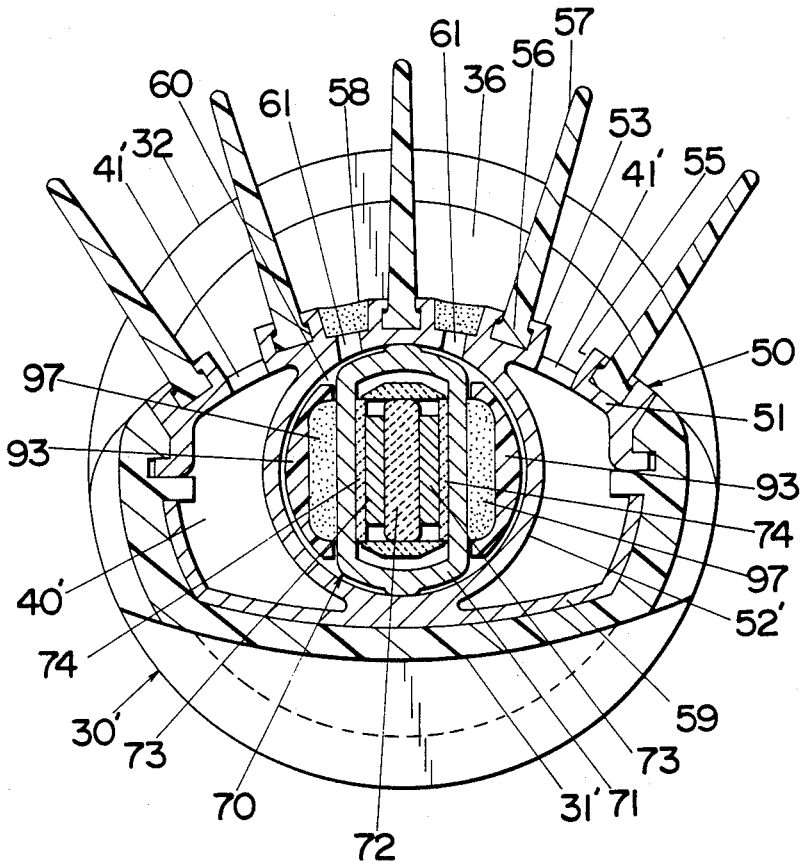
FIG. 9 is a cross section similar to FIG. 5 of a modification hair brush attachment.

FIG. 9 shows a modified hair brush attachment 30′ which is identical in structure to that of the above embodiment except that a heat conductive plate 59 extends integrally from the lower end of the pipe 52′ for covering substantially the entire inner surface of the base 31′ for heating the interior of the air flow chamber 40′. Thus, the steam entering the air flow chamber 40′ through the air vents 41' can be kept heated so as to be effectively prevented from being condensed to water. In this connection, the moisture absorbent pad 42 utilized in the above embodiment can be eliminated from the air flow chamber 40.

What is claimed is:

1. A hair dryer and steamer combination comprising:

a handle housing mounting therein a fan blower for producing a flow of air and formed at its front end with a discharge port for discharging the flow of air; and an elongated hair brush member having a hair engaging surface which extends in the lengthwise direction of said hair brush member for engagement with the hair strands to be styled and a steam generating device which comprises a water supplying means and an electric heater for heating the water supplied from said water supplying means to generate the steam;

said water supplying means including a tank and a plug with a moisturizing pad extending from within the tank for transferring water to the electric heater;

said hair brush member connected at its rear end to the front end of said handle housing so as to receive therefrom the flow of air;

said hair brush member being in the form of a hollow tube having an air flow chamber and a steam chamber which are elongated respectively in the lengthwise direction of said hair brush member and separated from each other;

said steam chamber is defined by a pipe which is open to a front end of said hair brush member for detachably receiving said plug;

said pipe having its inner wall sealed at its front end to said plug and at its rear end to said electric heater so as to define between the front and rear sealed portions a space within the length of which the electric heater is in contact with said moisturizing pad for generating the steam;

said air flow chamber being open to said discharge port of the handle housing and provided with a number of air vents which are open to said hair engaging surface for discharging therefrom the flow of air for drying the hair in engagement with said hair engaging surface;

said steam chamber being closed to said discharge port and accommodating therein said electric heater, said steam chamber having a portion forming the part of said hair engaging surface and provided in that portion with a number of steam vents for discharging the steam generated at said heater to the hair in engagement with said hair engaging surface; and said steam chamber and said hair engaging surface being commonly defined by a single member having good thermal conductivity.

2. A combination as set forth in claim 1, wherein said plug is bifurcated to have a pair of retainer legs which extend lengthwise of said pipe for carrying said moisturizing pad along the length thereof, said retainer legs being held in an overlying relation to the electric heater along the length of said pipe in order to press the moisturizing pad against said electric heater along its length.

3. A combination as set forth in claim 1, wherein said hair engaging surface is formed with at least one axially extending groove and said steam vents are spaced along said groove.

4. A combination as set forth in claim 1, wherein said pipe is provided within said space with a water absorbent material for absorbing droplets of the steam within said pipe.

5. A combination as set forth in claim 1, wherein said handle housing is provided with electric switch means for energizing said fan blower and said steam generating heater and is detachably connected at said discharge port to said hair brush member, said handle housing is provided with a connector for electrical connection between said switch means and said steam generating heater, and said connector is located at a portion of the periphery of said discharge port in axial alignment with said switch means.

6. A hair dryer and steamer combination comprising:

a handle housing mounting therein a fan blower for producing a flow of air and formed at its front end with a discharge port for discharging the flow of air; and an elongated hair brush member having a hair engaging surface which extends in the lengthwise direction of said hair brush member for engagement with the hair strands to be styled and a steam generating device which comprises a water supplying means and an electric heater for heating the water supplied from said water supplying means to generate the steam;

said water supplying means including a tank for containing a volume of water and a plug with a moisturizing pad extending from within the tank for transferring water to the electric heater in said steam chamber;

said hair brush member connected at its rear end to the front end of said handle housing so as to receive therefrom the flow of air;

said hair brush member being in the form of a hollow tube and having an elongated base with a top opening extending lengthwise of said hair brush member and a front opening;

an arcuate plate formed from a material having good thermal conductivity and extending lengthwise of said base to be fitted within the top opening of said base and providing said hair engaging surface;

a pipe integrally formed with said arcuate plate to extend on the undersurface of said arcuate plate in a lengthwise direction thereof and defining a steam chamber interiorly of said pipe and defining an air flow chamber exteriorly of said pipe between the base and said arcuate plate;

said steam chamber and said flow chamber being separated from each other;

an end plate fitted to the front opening of said base to close the front end of said air flow chamber, said end plate being formed with a water supply port in open communication with said steam chamber;

said plug being detachably inserted into said steam chamber through said water supply port and held in lockable engagement with said end plate;

said air flow chamber being open to said discharge port of the handle housing and provided with a number of air vents which are open to said hair engaging surface for discharging therefrom the flow of air for drying the hair in engagement with said hair engaging surface;

said steam chamber being closed to said discharge port and accommodating therein said electric heater; and said portion of said pipe formed integrally with said arcuate plate being provided with a number of steam vents for discharging the steam generated at said heater to the hair in engagement with said hair engaging surface.

7. A combination as set forth in claim 6, wherein said base has its inner wall covered with a heat conductive plate extending integrally from said pipe.

8. A combination as set forth in claim 6, wherein said base is provided on the inner wall thereof with a water absorbent material for absorbing droplets of steam within said air flow chamber.

9. A hair dryer and steamer combination comprising:

a handle housing mounting therein a fan blower for producing a flow of air and formed at its front end with a discharge port for discharging the flow of air; and an elongated hair brush member having a hair engaging surface which extends in the lengthwise direction of said hair brush member for engagement with the hair strands to be styled and a steam generating device which comprises a water supplying means and an electric heater for heating the water supplied from said water supplying means to generate the steam;

said hair brush member connected at its rear end to the front end of said handle housing so as to receive therefrom the flow of air;

said hair brush member being in the form of a hollow tube having an air flow chamber and a steam chamber which are elongated respectively in the lengthwise direction of said hair brush member and separated from each other;

said air flow chamber being open to said discharge port of the handle housing and provided with a number of air vents adjacent laterally spaced ends of said hair engaging surface and open to said hair engaging surface for discharging therefrom the flow of air for drying the hair in engagement with said hair engaging surface;

said steam chamber being closed to said discharge port and accommodating therein said electric heater, said steam chamber having a portion extending lengthwise along the middle of the lateral direction of said hair brush member and forming a part of said hair engaging surface and provided in that portion with a number of steam vents disposed in the laterally middle of said hair engaging surface for discharging the steam generated at said heater to the hair in engagement with said hair engaging surface; and said steam chamber and said hair engaging surface being commonly defined by a single member having good thermal conductivity.

10. A combination as set forth in claim 9, wherein said hair engaging surface is formed with at least one axially extending groove and said steam vents are spaced along said groove.

11. A combination as set forth in claim 9, wherein said handle housing is provided with electric switch means for energizing said fan blower and said steam generating heater and is detachably connected at said discharge port to said hair brush member, said handle housing is provided with a connector for electrical connection between said switch means and said steam generating heater, and said connector is located at a portion of the periphery of said discharge port in axial alignment with said switch means.

12. A hair dryer and steamer combination comprising:

a handle housing mounting therein a fan blower for producing a flow of air and formed at its front end with a discharge port for discharging the flow of air; and an elongated hair brush member having a hair engaging surface which extends in the lengthwise direction of said hair brush member for engagement with the hair strands to be styled and a steam generating device which comprises a water supplying means and an electric heater for heating the water supplied from said water supplying means to generate the steam;

said hair brush member connected at its rear end to the front end of said handle housing so as to receive therefrom the flow of air;

said hair brush member being in the form of a hollow tube having an air flow chamber and a steam chamber which are elongated respectively in the lengthwise direction of said hair brush member and separated from each other;

said air flow chamber being open to said discharge port of the handle housing and provided with a number of air vents which are open to said hair engaging surface for discharging therefrom the flow of air for drying the hair in engagement with said hair engaging surface;

said steam chamber being closed to said discharge port and accommodating therein said electric heater, said steam chamber having a portion forming a part of said hair engaging surface and provided in that portion with a number of steam vents for discharging the steam generated at said heater to the hair in engagement with said hair engaging surface;

said hair engaging surface including at least one axially extending groove filled with a steam diffusion pad having moisture absorbing capability along which said steam vents are spaced; and said steam chamber and said hair engaging surface are commonly defined by a single member having good thermal conductivity.

* * * * *

UNITED STATES PATENT AND TRADEMARK OFFICE

CERTIFICATE OF CORRECTION

PATENT NO. : 4,936,027

DATED : June 26, 1990

INVENTOR(S) : Eiji TSUJI

It is certified that error appears in the above-identified patent and that said Letters Patent is hereby corrected as shown below:

On the title page, after Item [22], the following should appear:

--[30] Foreign Application Priority Data

Jul. 15, 1987 [JP] Japan ..... 62-176272--.

Signed and Sealed this

Third Day of March, 1992

*Attest:*

HARRY F. MANBECK, JR.

*Attesting Officer*

*Commissioner of Patents and Trademarks*